US008307535B2

(12) United States Patent
Feller et al.

(10) Patent No.: US 8,307,535 B2
(45) Date of Patent: Nov. 13, 2012

(54) MULTI-FREQUENCY ANTENNA MANUFACTURING METHOD

(75) Inventors: Walter J. Feller, Airdrie (CA); Xiaoping Wen, Calgary (CA)

(73) Assignee: Hemisphere GPS LLC, Calgary, Alberta (CA)

( * ) Notice: Subject to any disclaimer, the term of this patent is extended or adjusted under 35 U.S.C. 154(b) by 0 days.

(21) Appl. No.: 13/187,305

(22) Filed: Jul. 20, 2011

(65) Prior Publication Data

US 2012/0186073 A1 Jul. 26, 2012

Related U.S. Application Data

(60) Provisional application No. 61/366,071, filed on Jul. 20, 2010.

(51) Int. Cl.
*H01P 11/00* (2006.01)

(52) U.S. Cl. ..... 29/600; 29/592.1; 29/832; 343/757

(58) Field of Classification Search ..... 29/600, 29/601.2, 592.1, 830–832; 343/795–798, 343/757, 700 MS; 342/464, 357.27
See application file for complete search history.

(56) References Cited

U.S. PATENT DOCUMENTS

| | | | | |
|---|---|---|---|---|
| 5,523,761 | A | 6/1996 | Gildea | |
| 5,557,656 | A | 9/1996 | Ray et al. | |
| 6,320,898 | B1 | 11/2001 | Newson et al. | |
| 6,516,271 | B2 | 2/2003 | Upadhyaya et al. | |
| 6,549,835 | B2 | 4/2003 | Deguchi | |
| 6,774,843 | B2 | 8/2004 | Takahashi | |
| 6,822,314 | B2 | 11/2004 | Beasom | |
| 6,897,328 | B2 | 5/2005 | Gutsche et al. | |
| 6,897,828 | B2 | 5/2005 | Boucher | |
| 6,999,042 | B2 | 2/2006 | Dearnley et al. | |
| 7,006,032 | B2 | 2/2006 | King et al. | |
| 7,089,099 | B2 | 8/2006 | Shostak et al. | |
| 7,224,246 | B2 | 5/2007 | Thomas | |
| 7,298,325 | B2 | 11/2007 | Krikorian et al. | |
| 8,102,325 | B2 * | 1/2012 | Feller et al. | 343/795 |
| 2005/0174297 | A1 | 8/2005 | Cake | |

(Continued)

FOREIGN PATENT DOCUMENTS

EP 0938190 8/1999

OTHER PUBLICATIONS

Parkinson, Bradford W., et al., "Global Positioning System: Theory and Applications, vol. II", Bradford W. Parkinson and James J. Spiker, Jr., eds., *Global Postioning System: Theory and Applicaitons*, vol. II, 1995, AIAA, Reston, VA, USA, pp. 3-50, (1995),3-50.

(Continued)

*Primary Examiner* — Minh Trinh
(74) *Attorney, Agent, or Firm* — Law Office of Mark Brown, LLC; Mark E. Brown

(57) ABSTRACT

A multi-frequency GNSS antenna is provided which can be manufactured from PCB materials and exhibits good multi-path rejection. The antenna is capable of receiving RHCP signals from all visible GNSS satellites across a wide beam-width. A multi-frequency GNSS antenna manufacturing method includes the steps of providing PCB base and support assemblies, first and second feed networks and connecting said first and second feed networks to first and second hybrid connector outputs.

3 Claims, 10 Drawing Sheets

U.S. PATENT DOCUMENTS

| | | | | |
|---|---|---|---|---|
| 2007/0229376 | A1* | 10/2007 | Desclos et al. | 343/718 |
| 2007/0285308 | A1 | 12/2007 | Bauregger et al. | |
| 2010/0117914 | A1 | 5/2010 | Feller et al. | |
| 2010/0211314 | A1 | 8/2010 | Zhukov | |
| 2010/0226354 | A1 | 9/2010 | Duzdar et al. | |
| 2010/0231468 | A1 | 9/2010 | Ogino et al. | |

OTHER PUBLICATIONS

"Orthman Manufacturing Co., www.orthman.com/htm;guidance.htm", 2004, regarding the "Tracer Quick-Hitch".

Lin, Dai et al., "Real-time Attitude Determination fro Microsatellite by Lamda Method Combined with Kalman Filtering", *A Collection fof the 22nd AIAA International Communications Satellite Systems Conference and Exhibit Technical Papers* vol. 1, Monetrey, California American Institute of Aeronautics and Astronautics, Inc., (May 2004),136-143.

Xu, Jiangning et al., "An EHW Architecture for Real-Time GPS Attitude Determination Based on Parallel Genetic Algorithm", *The Computer SocietyProceedings of the 2002 NASA/DOD Conference on Evolvable Hardware* (*EH'02*), (2002).

Han, Shaowel et al., "Single-Epoch Ambiguity Resolution for Real-Time GPS Attitude Determination with the Aid of One-Dimensional Optical Fiber Gyro", *GPS Solutions*, vol. 3, No. 1, pp. 5-12 (1999) *John Wiley & Sons, Inc.*

Park, Chansik et al., "Integer Ambiguity Resolution for GPS Based Attitude Determination System", *SICE 1998*, Jul. 29-31, Chiba, 1115-1120.

Yang, F. et al., "A single layer dual band circularly polorized micropstrip antenna for GPS application", *IEEE Antenna and Propagation Society International Symposium*, vol. 4. pp. 720-723, Jun. 2002, 720-723.

Padhi, K. et al., "An EM-coupled dual-polarized microstrip patch antenna for RFID applications", *Microwave and optical technology letter*, vol. 39., No. 5, pp. 345-360, 2003, 345-360.

Last, J. D., et al., "Effect of skywave interference on coverage of radiobeacon DGPS stations", *IEEE Proc.-Radar, Sonar Navig.*, vol. 144, No. 3, Jun. 1997, pp. 163-168.

"International Search Report and Written Opinion", PCT/US2004/015678, filed May 17, 2004, (Nov. 21, 2006).

"ISO", *11783 Part 7 Draft Amendment 1 Annex*, Paragraphs B.6 and B.7.ISO 11783-7 2004 DAM1 ISO: Mar. 8, 2004.

Kaplan, E D., "Understanding GPS: Principles and Applications", *Artech House*, MA, 1996.

Irsigler, M et al., "PPL Tracking Performance in the Presence of Oscillator Phase Noise", *GPS Solutions*, vol. 5, No. 4, pp. 45-57 2002.

Ward, Phillip W., "Performance Comparisons Between FLL, PLL and a Novel FLL-Assisted-PLL Carrier Tracking Loop Under RF Interference Conditions", *11th Int. Tech Meeting of the Satellite Division of the U.S. Inst. of Navigation*, Nashville, TN, Sep. 15-18, 783-795, 1998.

Bevly, David M., "Comparison of INS v. Carrier-Phase DGPS for Attitude Determination in the Control of Off-Road Vehicles", *Ion 55th Annual Meeting*; Jun. 28-30, 1999; Cambridge, Massachusetts; pp. 497-504.

"International Search Report and Written Opinion", *International Searching Authortiy*, PCT/US08/88070, Feb. 9, 2009.

Richter, Paul H., et al., "Improved Blind Pointing of NASA's Beam-Waveguide Antennas for Millimeter Wave Operation", *Jet Propulsion Lab Technical Report Series 1992*. Published Apr. 4, 2000.

Keicher, R. et al., "Automatic Guidance for Agricultural Vehicles in Europe", *Computers and Electronics in Agriculture*, vol. 25, (Jan. 2000),169-194.

"KMW Communications", *PAC* (*Portable Antenna Controller*); http://www.kmwcomm.com; Retrieved from internet Jun. 8, 2009.

Takac, Frank et al., "SmartRTK: A Novel Method of Processing Standardised RTCM Network RTK Information for High Precision Positioning", *Proceedings of ENC GNSS 2008*, Toulouse, France,(Apr. 22, 2008).

"International Search Report", PCT/US09/33567, (Apr. 7, 2009).

"International Search Report", PCT/US09/49776, (Aug. 11, 2009).

"International Search Report", PCT/AU/2008/000002, (Feb. 28, 2008).

"International Search Report and Written Opinion", PCT/IB2008/003796, (Jul. 15, 2009).

"International Search Report", PCT/US09/33693, (Mar. 30, 2009).

"International Search Report", PCT/US09/039686, (May 26, 2009).

"International Search Report,", PCT/US09/34376, (Nov. 2, 2009).

"International Search Report / Written Opinion", PCT/US09/63594, (Jan. 11, 2010).

"International Search Report", PCT/US09/60668, (Dec. 9, 2009).

"International Search Report", PCT/US09/067693, (Jan. 26, 2010).

"International Search Report and Written Opinion", PCT/US10/21334, (Mar. 12, 2010).

Rho, Hyundho et al., "Dual-Frequency GPS Precise Point Positioning with WADGPS Corrections", [retrieved on May 18, 2010]. Retrieved from the Internet: ,URL: http://gauss.gge.unb.ca/papers.pdf/iongnss2005.rho.wadgps.pdf, (Jul. 12, 2006).

"Eurocontrol, Pegasus Technical Notes on SBAS", *report* [online], Dec. 7, 2004 [retrieved on May 18, 2010]. Retrieved from the Internet: <URL: http://www.icao.int/icao/en/ro/nacc/nneetings/2004/gnss/documentation/Pegasus/tn.pdf>, (Jun. 17, 2003),p. 89 paras [0001]-[0004].

"Arinc Engineering Services, Interface Specification IS-GPS-200, Revision D", *Online* [retrieved on May 18, 2010]. Retrieved from the Internet;<URL: http://www.navcen.uscg.gov/gps/geninfo/IS-GPS-200D.pdf>, (Dec. 7, 2004),p. 168 para [0001].

Schaer, et al., "Determination and Use of GPS Differential Code Bias Values", *Presentation* [online]. Revtrieved May 18, 2010. Retrieved from the internet: <http://nng.esoc.esa.de/ws2006/REPR2.pdf>., (May 8, 2006).

"RFS Product Preview", *RFS Product Brochure*, (Dec. 22, 2008),1 of 1.

"International Search Report & Written Opinion", PCT/US10/26509, (Apr. 20, 2010),1-7.

"PAC-Manual", *KMW RF & Microwave Products—Company Confidential*, (Jul. 9, 2008).

"Notification Concerning Transmittal of International Report on Patentability (PCT)", PCT/US2009/049776, (Jan. 20, 2011).

"Notification of Transmittal of InternatinalPrelim. Report of Patentability", International application No. PCT/US09/039686, Oct. 21, 2010.

"International Search Report and Written Opinion", PCT/US2010/043094, (Sep. 17, 2010).

"Notification of Publication of International Application", WO 2011/014431, (Feb. 3, 2011).

"International Search Report and Written Opinion", PCT/US08/81727, (Dec. 23, 2008).

"International Preliminary Report on Patentability", PCT/US2009/033567, (Aug. 10, 2010),1-8.

"International Preliminary Report on Patentability", International Application No. PCT/2009/063594, International Filing Date Nov. 6, 2009, Priority Date Nov. 10, 2008, Issue Date May 10, 2011.

* cited by examiner

MULTI-FREQUENCY ANTENNA MANUFACTURING METHOD

CROSS-REFERENCE TO RELATED APPLICATION

This application claims priority in U.S. provisional patent application Ser. No. 61/366,071, filed Jul. 20, 2010, which is incorporated herein by reference.

BACKGROUND OF THE INVENTION

1. Field of the Invention

The present invention relates generally to antennas, and in particular to a high-performance, multipath-rejecting antenna which forces correct polarization over a wide beamwidth including multiple Global Navigation Satellite System (GNSS) frequencies. A method of manufacturing such an antenna with a three-dimensional structure uses relatively inexpensive printed circuit board (PCB) production techniques.

2. Description of the Related Art

Various antenna designs and configurations have been produced for transmitting and receiving electromagnetic (wireless) signals. Antenna design criteria include performance considerations, such as the signal characteristics and the transmitters and receivers. Antenna manufacturing considerations include cost and compliance with manufacturing tolerances related to performance criteria. Antenna performance, cost and manufacturing considerations are important factors in connection with wireless devices in general, and particularly for GNSS receivers.

GNSSs include the Global Positioning System (GPS), which was established by the United States government and employs a constellation of 24 or more satellites in well-defined orbits at an altitude of approximately 26,500 km. These satellites continually transmit microwave L-band radio signals in three frequency bands, centered at 1575.42 MHz, 1227.60 MHz and 1176.45 MHz, denoted as L1, L2 and L5 respectively. All GNSS signals include timing patterns relative to the satellite's onboard precision clock (which is kept synchronized by a ground station) as well as a navigation message giving the precise orbital positions of the satellites. GPS receivers process the radio signals, computing ranges to the GPS satellites, and by triangulating these ranges, the GPS receiver determines its position and its internal clock error. Different levels of accuracy can be achieved depending on the techniques employed.

GNSS also includes Galileo (Europe), the GLObal NAvigation Satellite System (GLONASS, Russia), Compass (China, proposed), the Indian Regional Navigational Satellite System (IRNSS) and QZSS (Japan, proposed). Galileo will transmit signals centered at 1575.42 MHz, denoted L1 or E1, 1176.45 denoted E5*a*, 1207.14 MHz, denoted E5*b*, 1191.795 MHz, denoted E5 and 1278.75 MHz, denoted E6. GLONASS transmits groups of FDM signals centered approximately at 1602 MHz and 1246 MHz, denoted GL1 and GL2 respectively, and 1278 MHz. QZSS will transmit signals centered at L1, L2, L5 and E6. Groups of GNSS signals are herein grouped into "superbands."

Multi-frequency capabilities provide several advantages. First, ionospheric errors can be corrected. Secondly, signals received on multiple frequencies can be averaged, thus reducing the effects of noise. Multipath errors from reflected signals also tend to be minimized with multi-frequency signal averaging techniques. Still further, an additional signal band(s) is available in case one frequency band is not available, e.g., from jamming.

Spiral-element and crossed-dipole antennas tend to provide relatively good performance for GNSS applications. They can be designed for multi-frequency operation in the current and projected GNSS signal bandwidths. Such antenna configurations can also be configured for good multipath signal rejection, which is an important factor in GNSS signal performance. An example of a crossed-dipole GNSS antenna is shown in Feller and Wen U.S. patent application Ser. No. 12/268,241, Publication No. US 2010/0117914 A1, entitled GNSS Antenna with Selectable Gain Pattern, Method of Receiving GNSS Signals and Antenna Manufacturing Method, which is incorporated herein by reference.

Multipath interference is caused by reflected signals that arrive at the antenna out of phase with the direct line-of-sight (LOS) signals. Multipath interference is most pronounced at low elevation angles, e.g., from about 10° to 20° above the horizon. They are typically reflected from the ground and ground-based objects. Antennas with strong gain patterns at or near the horizon are particularly susceptible to multipath signals, which can significantly interfere with receiver performance based on direct line-of-sight (LOS) reception of satellite ranging signals and differential correction signals (e.g., DGPS).

GNSS satellites transmit right hand circularly polarized (RHCP) signals. Reflected GNSS signals become left hand circularly polarized (LHCP) and are received from below the horizon as multipath interference, tending to cancel and otherwise interfere with the reception of line-of-sight (LOS) RHCP signals. Rejecting such multipath interference is important for optimizing GNSS receiver performance and accurately computing geo-referenced positions. Receiver system correlators can be designed to reject multipath signals. The antenna design of the present invention rejects LHCP signals, minimizes gain below the horizon and forces correct polarization (RHCP) over a relatively wide beamwidth for multiple frequencies of RHCP signals from above the horizon.

Previous GNSS antennas have addressed these design criteria. For example, prior art phasing networks were constructed with coaxial cables. However, precisely matching cable lengths tended to be difficult and expensive. Inductors and capacitors were also used in LC antenna circuits for delaying signals to achieve phase differencing. The tolerances of inductors and capacitors are difficult to maintain at these frequencies and are subject to stray capacitance and inductance due to the interconnections. A further prior art technique required two pairs of arms with resonances tuned off-center to create different phasing. However, the resulting bandwidths were relatively narrow and were susceptible to detuning by interference from the enclosure and other interference sources in the surrounding environment, such as the presence of ice and human contact.

Constructing precise phase-matching, multi-frequency, multipath-rejecting antenna systems with conventional prior art discrete components and manufacturing techniques tended to be relatively expensive, complicated and imprecise. Prior art antenna performance was compromised by imprecise phase-matching. Printed circuit board (PCB) materials and manufacturing techniques, on the other hand, are generally cost-effective and readily available. Moreover, PCBs can be etched to relatively tight tolerances. Maintaining such tolerances is important because the separate signal paths must be relatively precisely equal in length in order to avoid changing the phase differences or amplitudes of the signals before they reach the radiating elements, which are delayed 90° with respect to each other. Moreover, the signal paths need to be isolated from each other to avoid cross-path interaction and signal distortion.

The present invention addresses the aforementioned GNSS antenna design criteria by providing an antenna and manufacturing method using printed circuit board (PCB) materials and common manufacturing techniques.

Heretofore there has not been available an antenna and manufacturing method with the advantages and features of the present invention.

SUMMARY OF THE INVENTION

In the practice of an aspect of the present invention, a multi-frequency GNSS antenna is provided which can be manufactured from PCB materials and exhibits good multipath rejection. The antenna is capable of receiving RHCP signals from all visible GNSS satellites across a wide beamwidth.

DETAILED DESCRIPTION OF THE PREFERRED EMBODIMENTS

I. Introduction and Environment

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, up, down, front, back, right and left refer to the invention as oriented in the view being referred to. The words "inwardly" and "outwardly" refer to directions toward and away from, respectively, the geometric center of the embodiment being described and designated parts thereof. Said terminology will include the words specifically mentioned, derivatives thereof and words of similar meaning. Global navigation satellite systems (GNSS) are broadly defined to include GPS (U.S.), Galileo (proposed), GLONASS (Russia), Compass (China, proposed), IRNSS (India, proposed), QZSS (Japan, proposed) and other current and future positioning. Said terminology will include the words specifically mentioned, derivatives thereof and words of similar meaning.

Without limitation on the generality of useful applications of the antennas of the present invention, GNSS represents an exemplary application, which utilizes certain advantages and features.

II. Spiral Element GNSS Antenna 2

Figure 1:
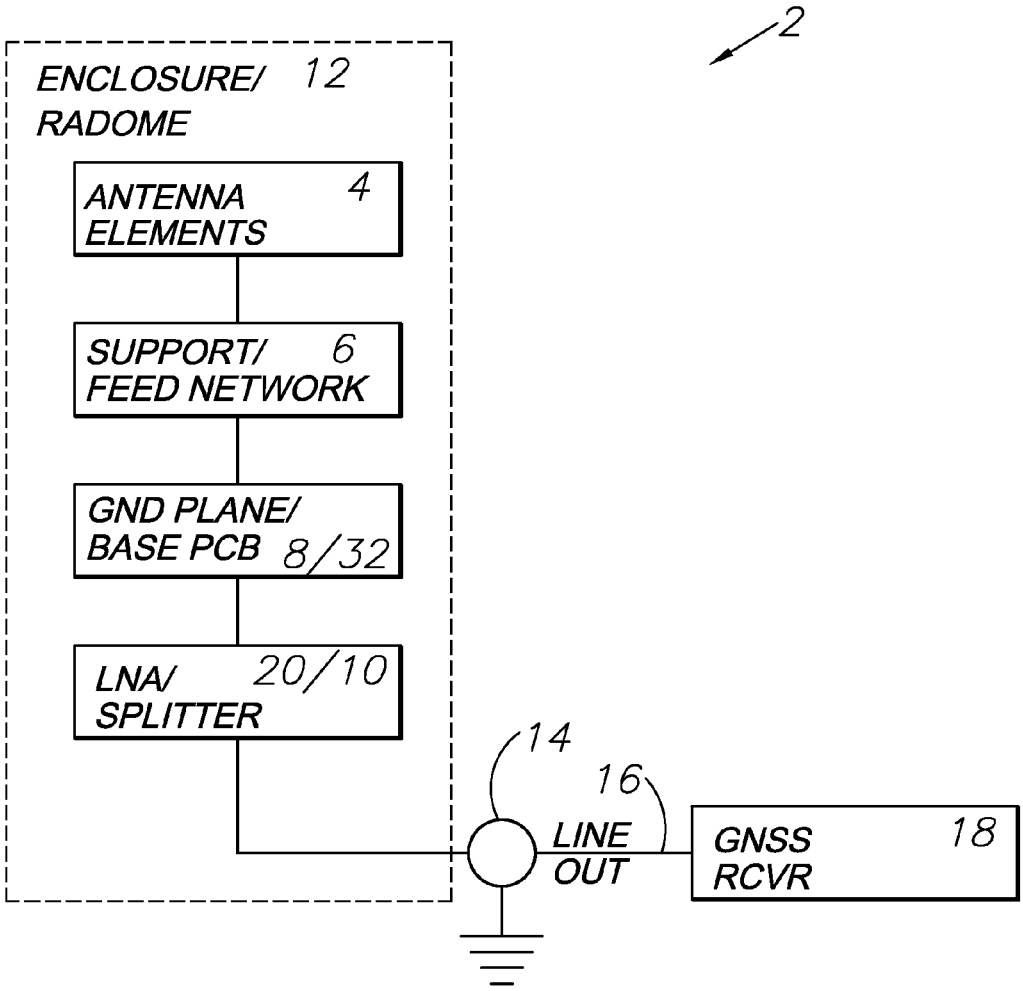
FIG. 1 is a diagram of a GNSS receiver and a high performance antenna embodying an aspect of the present invention.

Referring to FIG. 1 of the drawings in more detail, the reference numeral 2 generally designates a GNSS antenna embodying an aspect of the present invention. The antenna 2 generally comprises a crossed-dipole configuration with a spiral radiating element assembly 4 mounted on a PCB vertical support assembly 6, which is mounted on a PCB ground plane base assembly 8, on which is mounted a low noise amplifier (LNA) 20 and a hybrid coupler 10. A radome cover 12 encloses the antenna 2 internal components, and can be weatherproof for mounting in locations exposed to the elements. An output 14 is adapted for connection to an output line 16 for providing the GNSS signals as input to a GNSS receiver 18. The antenna 2 is compatible with GNSS receivers capable of receiving wide beamwidths of multiple GNSS frequencies, and is particularly adapted for meeting high-performance specifications including precisely phasing RHCP signals and rejecting LHCP multipath signals.

Figure 2:
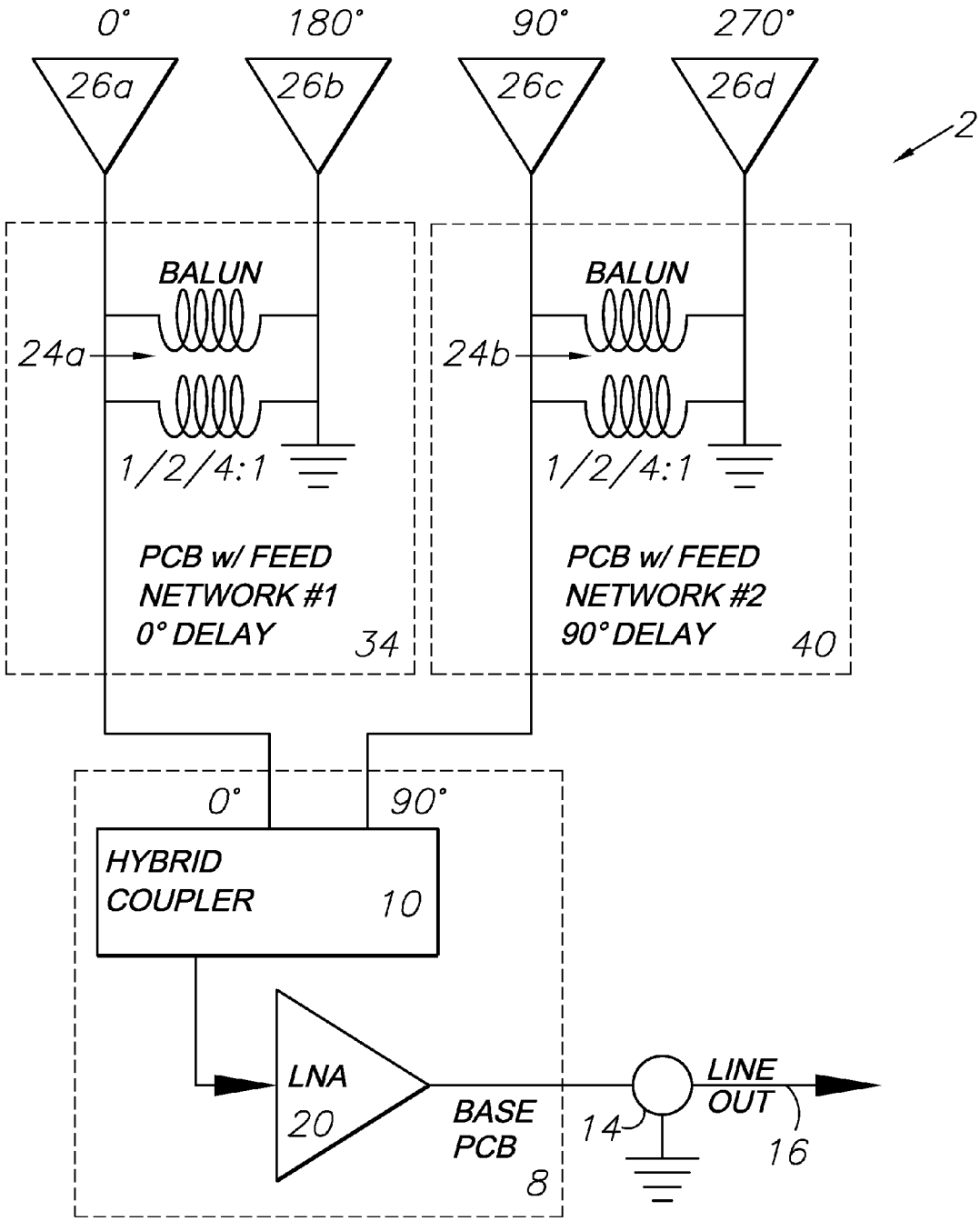
FIG. 2 is a diagram of the antenna, particularly showing its signal-splitting feed paths.

FIG. 2 shows the major components of the antenna 2, including the base assembly 8 with a low noise amplifier (LNA) 20 and a hybrid coupler (splitter) 10, which divides the RF path into 2 paths with minimal losses, one at 0° delay and the other at 90° delay. Each of these RF paths is fed to a PCB feed network 22*a,b* including a respective balanced/unbalanced (balun) transformer 24*a,b*, which further splits the signal with a 180° delay. The baluns 24*a,b* can provide 1:1, 2:1, 4:1 or other suitable impedance matches. The RF signal is thus finally split into four equal RF signal paths at radiating elements 26*a,b,c,d* at 90° intervals.

III. Antenna 2 Construction

FIGS. 3-6 show the construction of the spiral element antenna 2 from PCB materials using precision etching techniques for precisely phase-matching the RF signal feed paths and thus optimizing performance A PCB panel 30 can comprise any suitable PCB material. For example, FR-4 is the National Electrical Manufacturers Association (NEMA) designation for glass reinforced epoxy laminate sheets with good electrical insulating and mechanical strength properties. Without limitation on the generality of useful PCB materials, FR-4 is adaptable for printing the base, support, feed and radiating element components of the antenna 2.

Figure 3:
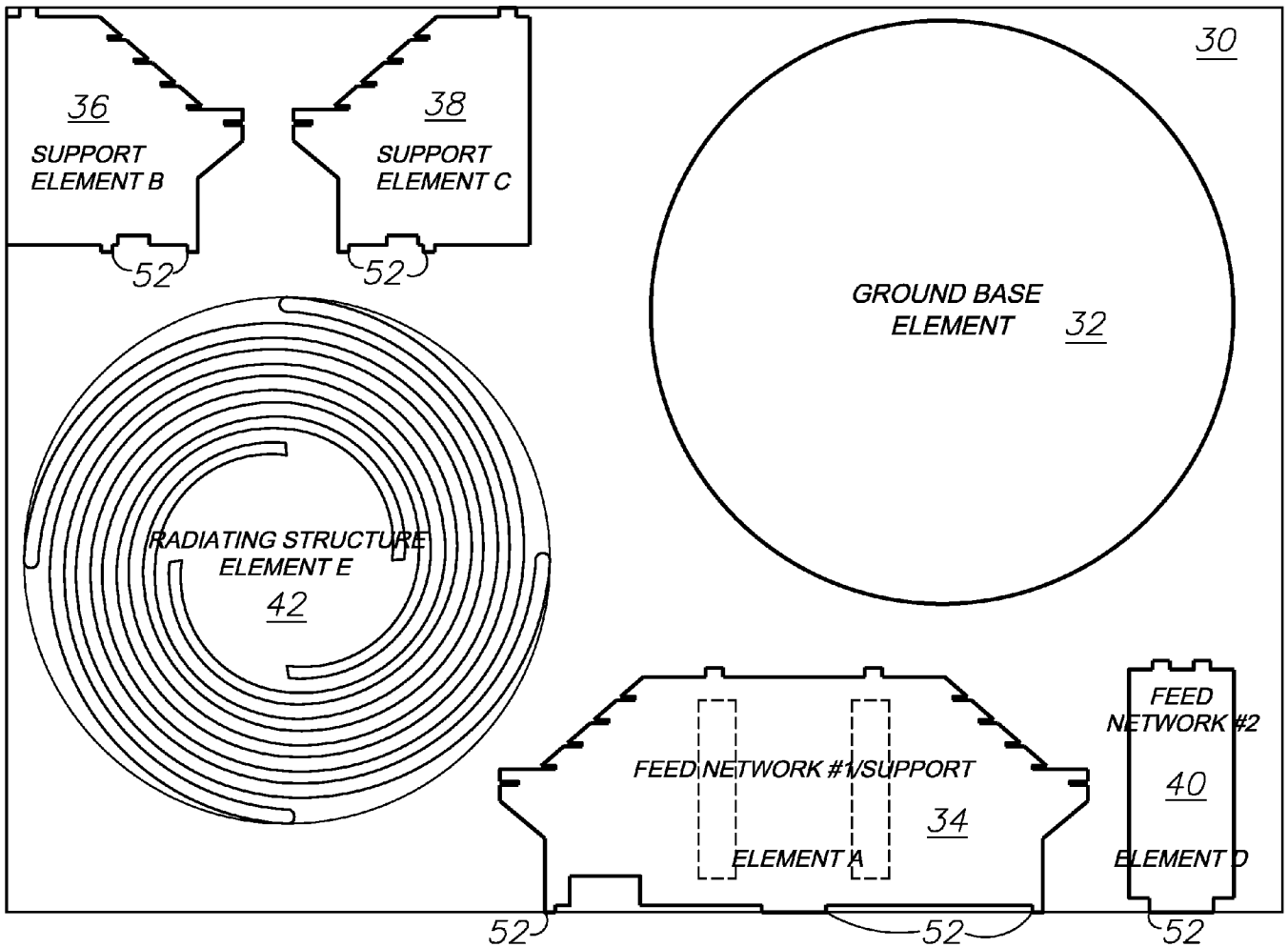
FIG. 3 is an exemplary printed circuit board (PCB) layout for the PCB components of a spiral radiating element antenna comprising an aspect of the present invention.

As shown in FIG. 3, the panel 30 can provide a ground base PCB subpanel 32, a combined feed network #1/support subpanel A 34, a support subpanel B 36, a support subpanel C 38, a feed network #2 subpanel D 40 and a spiral radiating structure subpanel E 42. Using common and well-known PCB manufacturing techniques, the subpanels can be precisely etched to highly accurate and repeatable tolerances of approximately 0.001". The phase delay consistency between each of the four feeds is maintained by the use of a four-layer PCB construction, which provides two separate feed network subpanels 34, 40 each providing two signal paths and vertically overlapping each other. This construction provides four microstrip lines of controlled impedances and precisely matching electrical lengths to join the four antenna elements 26*a,b,c,d* without requiring the traces to cross or go through a via, which is a plated through-hole with a complex phase response over a wide range of frequencies that are difficult to compensate for.

Figure 4:
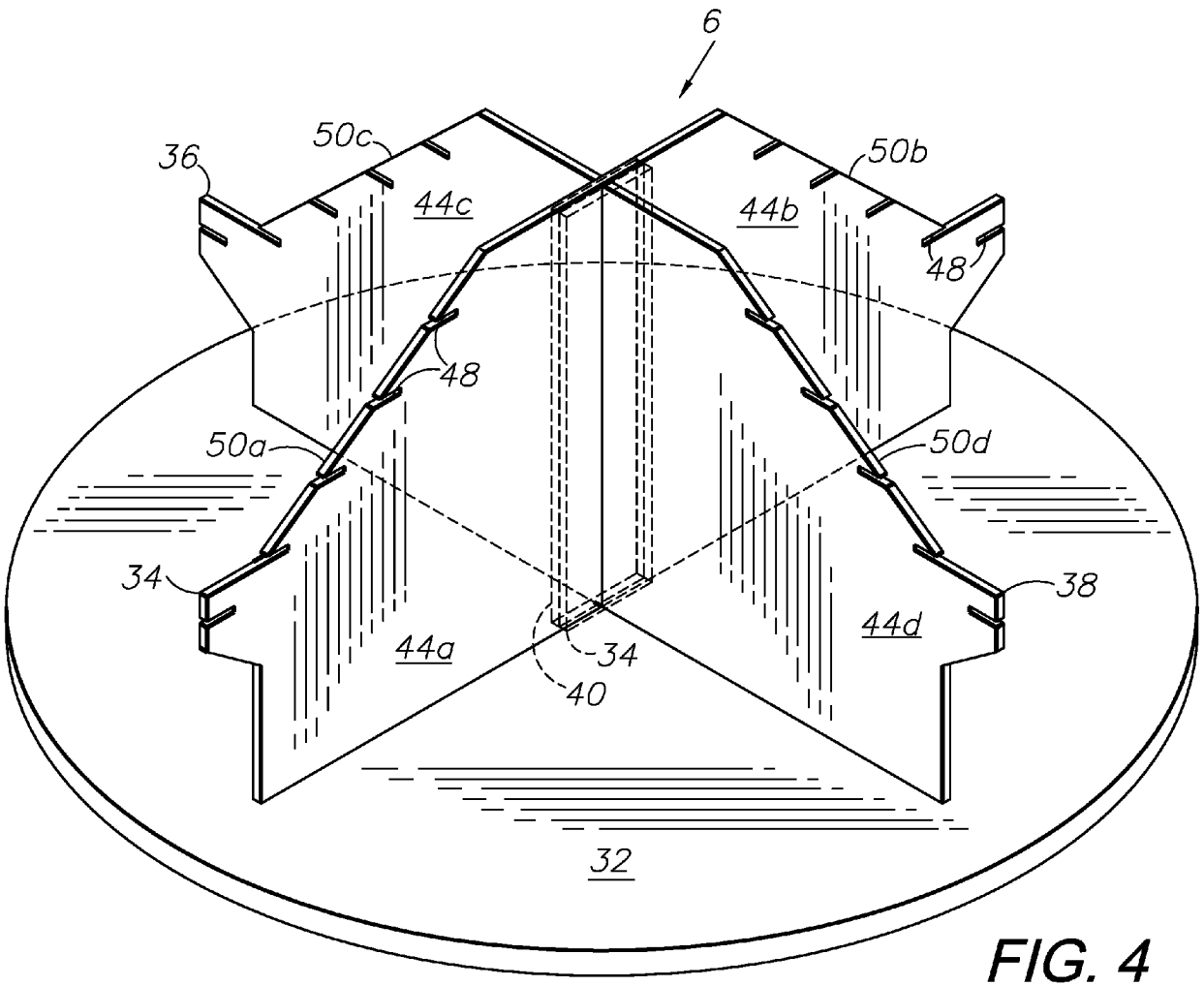
FIG. 4 is a perspective view of the assembly of the spiral radiating element antenna.

FIG. 4 shows the first phase of constructing the antenna 2 whereby the feed network #1/support 34 is mounted on the ground base 32 of the base assembly 8 and the additional supports 36, 38 are mounted at 90° angles to form a support assembly 44 comprising individual support legs 44*a,b,c,d* arrayed radially at 90° intervals with respect to each other. The feed network #2 40 is preferably mounted back-to-back with the feed network #1 34 to provide matched signal paths to the baluns 24*a,b* and then to the radiating elements 26*a,b,c,d*. The feed networks 34, 40 are isolated from each other by the ground plane base assembly 8 located therebelow.

Figure 5:
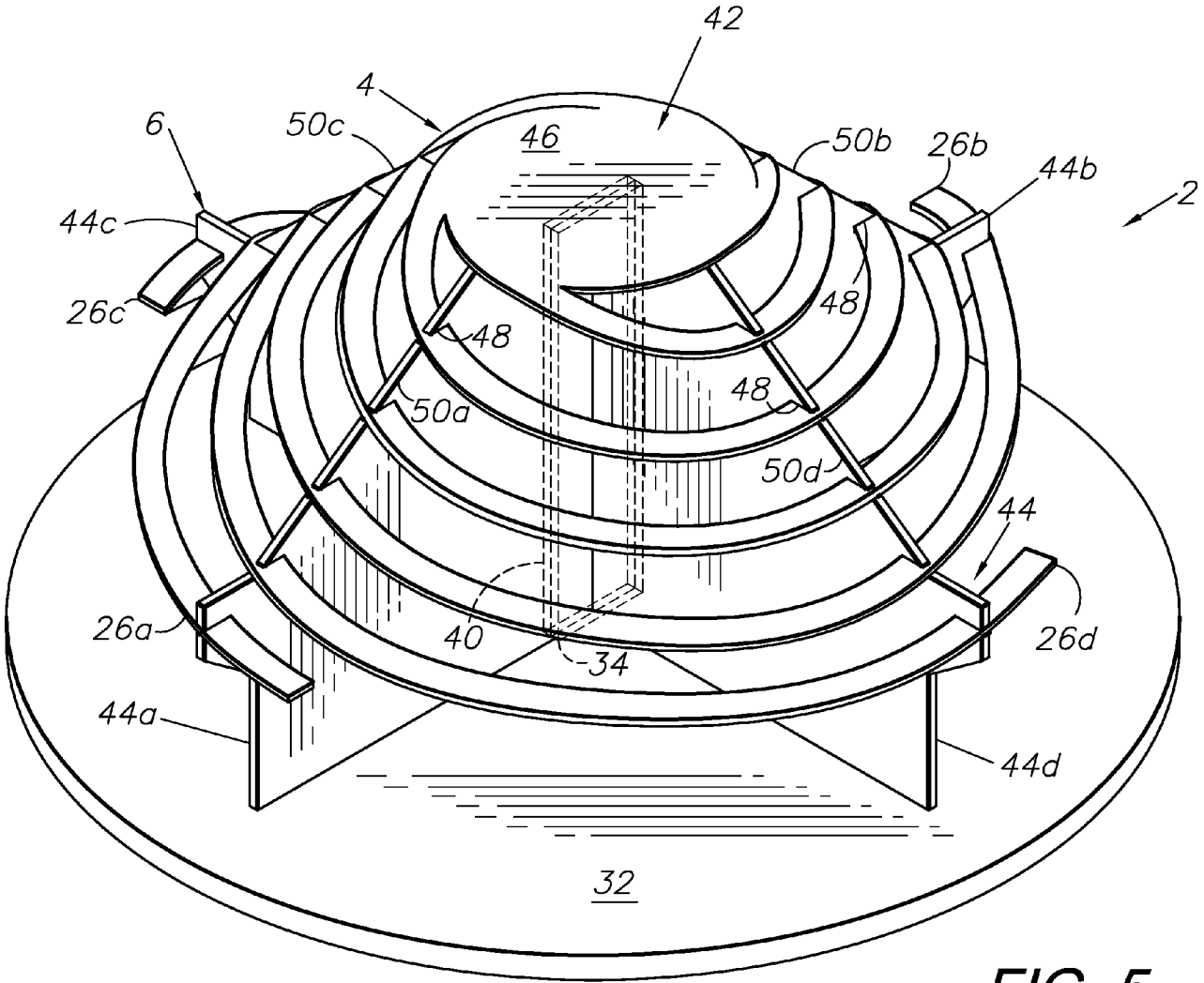
FIG. 5 is another perspective view of the assembly of the antenna, showing the radiating element structure.
Figure 6:
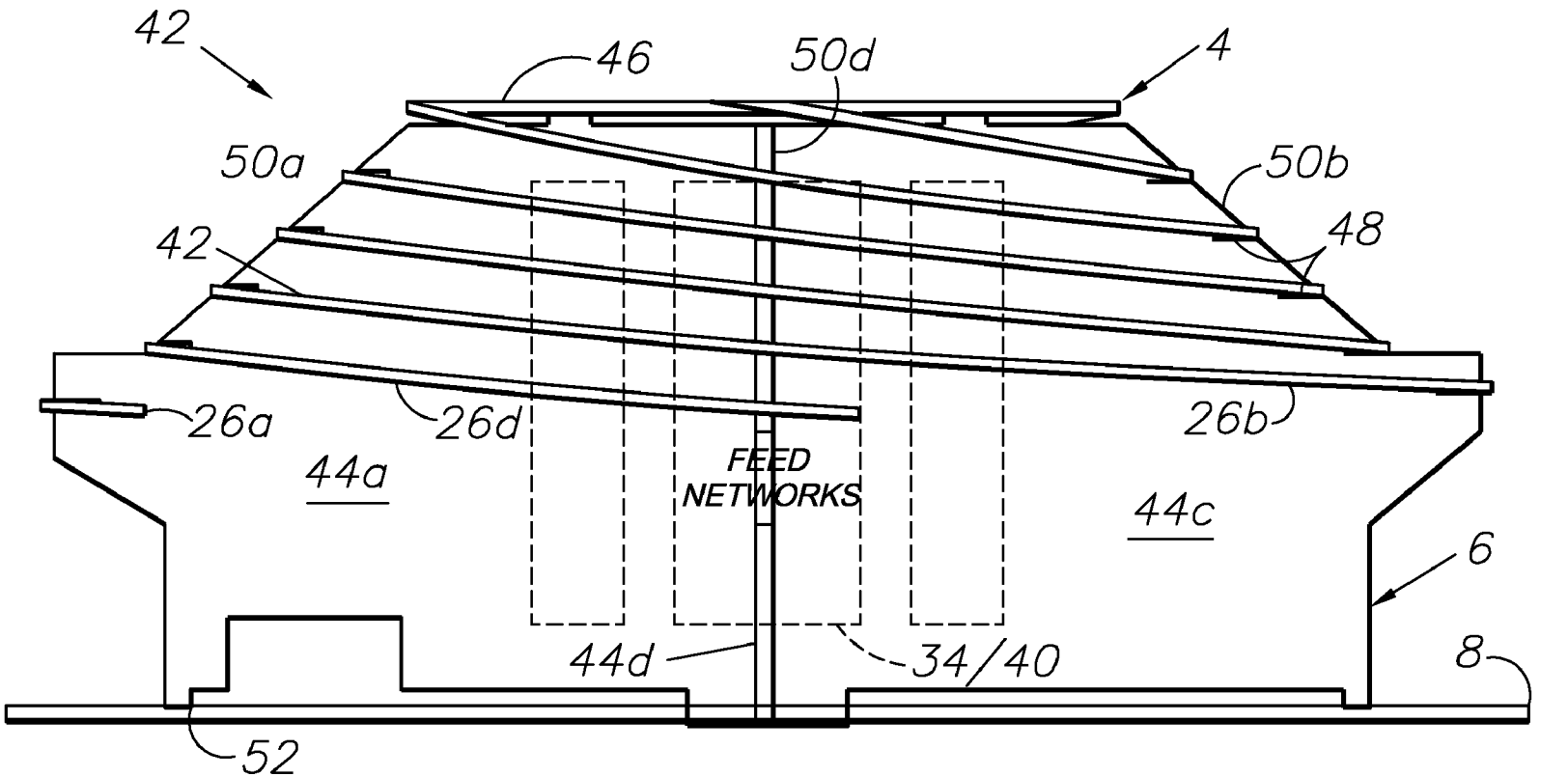
FIG. 6 is a side elevation view of the antenna.

FIG. 5 shows the second phase of constructing the antenna 2 whereby the radiating structure PCB subpanel E 42 is mounted on the support assembly 44. The spiral/helical configuration as shown provides a right hand polarization. As shown in FIG. 5, the radiating structure (PCB element E) 42 forms the spiral, RHCP antenna subpanel assembly/array 4 including a top-mounted hub 46 mounted on top of the vertical support assembly 6 and connected to the feed networks 34, 40 via the balun transformers 24*a,b*. Spiral/helical configuration radiating elements or arms 26*a,b,c,d* extend generally tangentially from the hub 46 at 90° radially-spaced intervals and are received in respective notches 48 formed in sloping, upper, outer edges 50*a,b,c,d* of the support assembly arms 44*a,b,c,d*. FIG. 6 shows the fully constructed antenna 2 with the radiating structure subpanel 42 and the feed networks 34, 40 mounted on the vertical support assembly 6.

The PCB subpanels can be provided with suitable tabs 52 for placement in slots formed in other PCB subpanels for facilitating accurate assembly.

IV. Alternative Aspect Antenna 102

Figure 7:
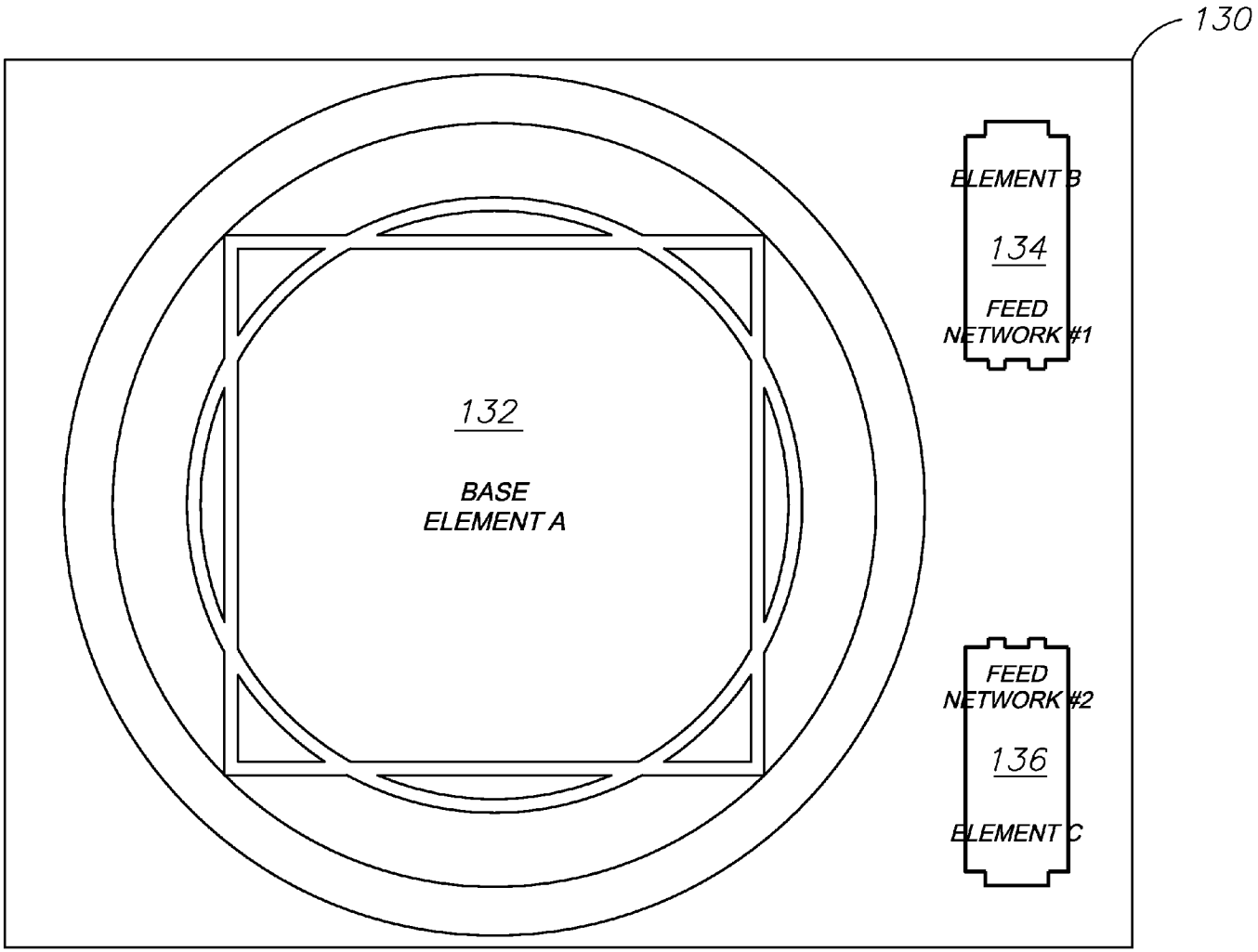
FIG. 7 is a PCB layout for components of an antenna comprising an alternative aspect of the present invention.
Figure 8:
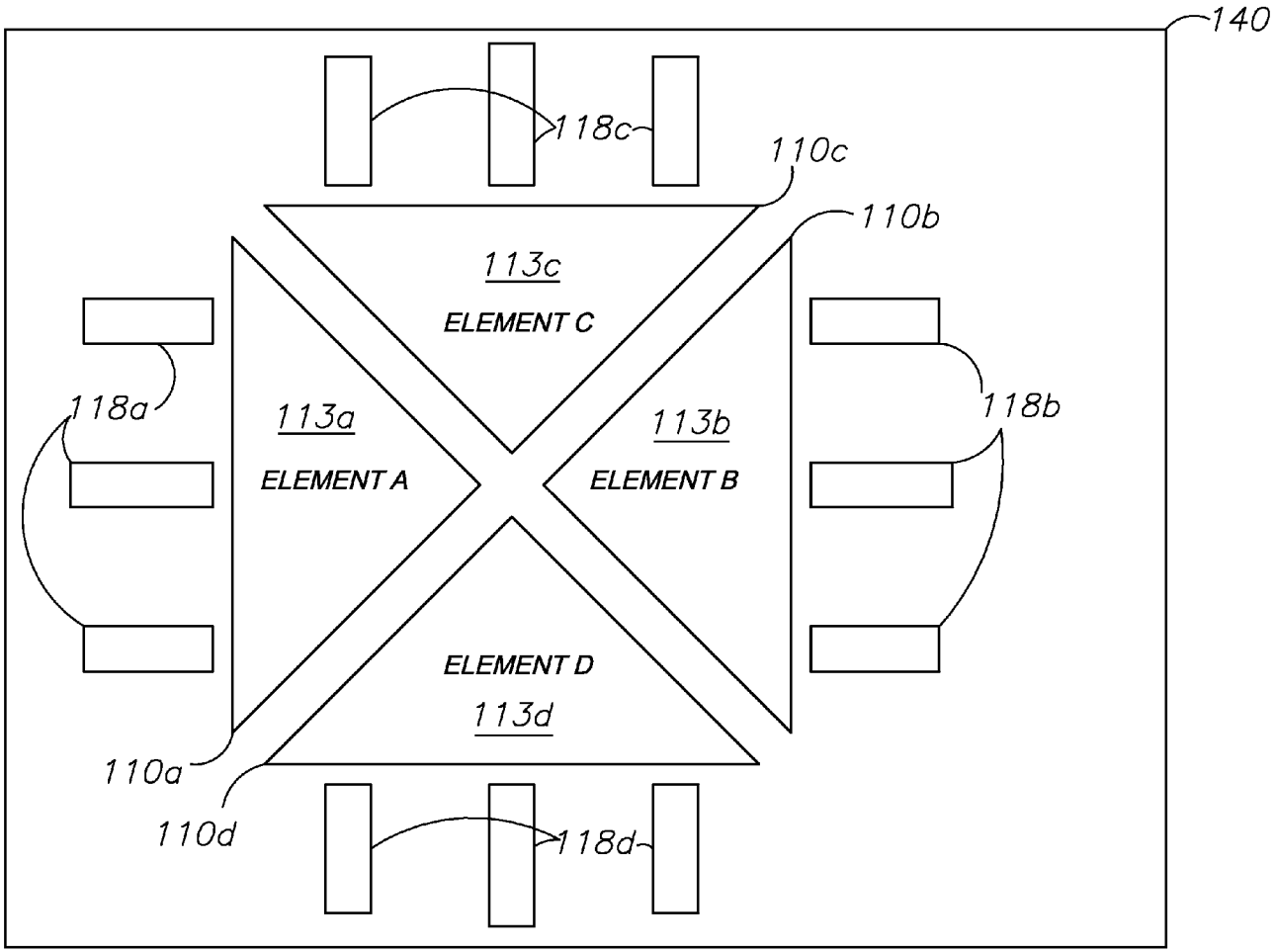
FIG. 8 is a PCB layout for additional components of the alternative aspect antenna.
Figure 9:
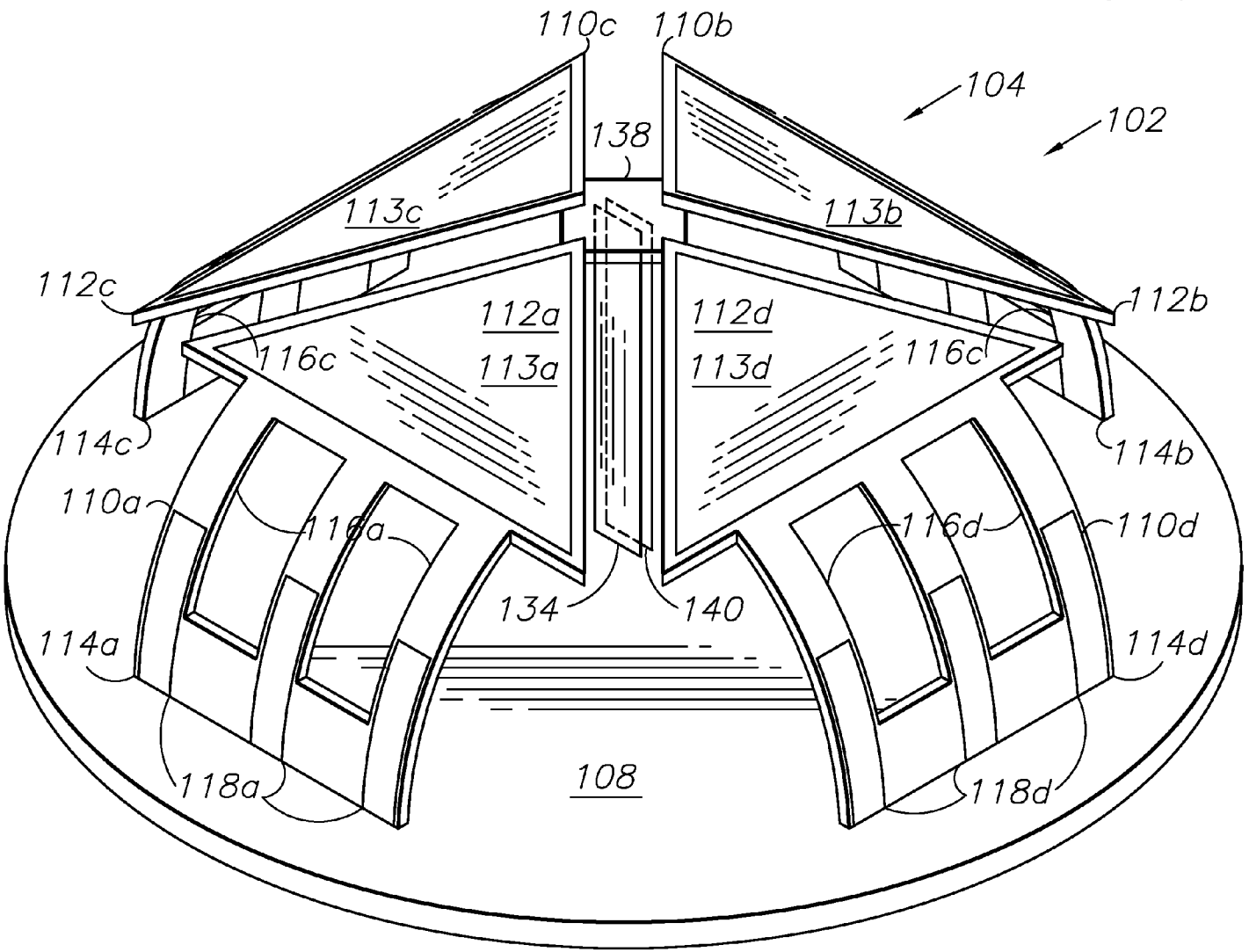
FIG. 9 is a perspective view of the alternative aspect antenna.

FIGS. 7-9 show the construction of a crossed-dipole, active antenna 102 manufactured from PCB materials comprising a modified or alternative aspect of the present invention. As shown in FIG. 7, a PCB panel 130 can provide a base PCB 132, a feed network #1PCB 134 and a feed network #2 PCB 136. FIG. 8 shows another PCB panel 140 forming a flexible cross dipole "bow tie" configuration element structure 104 for the antenna 102. The bow tie structure 104 comprises four active antenna subpanels 110*a,b,c,d* each comprising a respective triangular head 112*a,b,c,d* with a conductor area 113*a,b,c,d* mounted on a respective leg assembly 114*a,b,c,d* with cutouts 116*a,b,c,d* separating respective conductors 118*a,b,c,d*. FIG. 9 shows the assembled antenna 102. The feed networks 134, 136 are vertically mounted on the base PCB 132 and support a top connector subpanel 138, which is attached to the subpanel heads 112*a,b,c,d* at the top of the antenna 102. The antenna 102 can be configured similarly to the antenna 2 with similar operating characteristics and circuit layouts.

V. Conclusion

Figure 10:
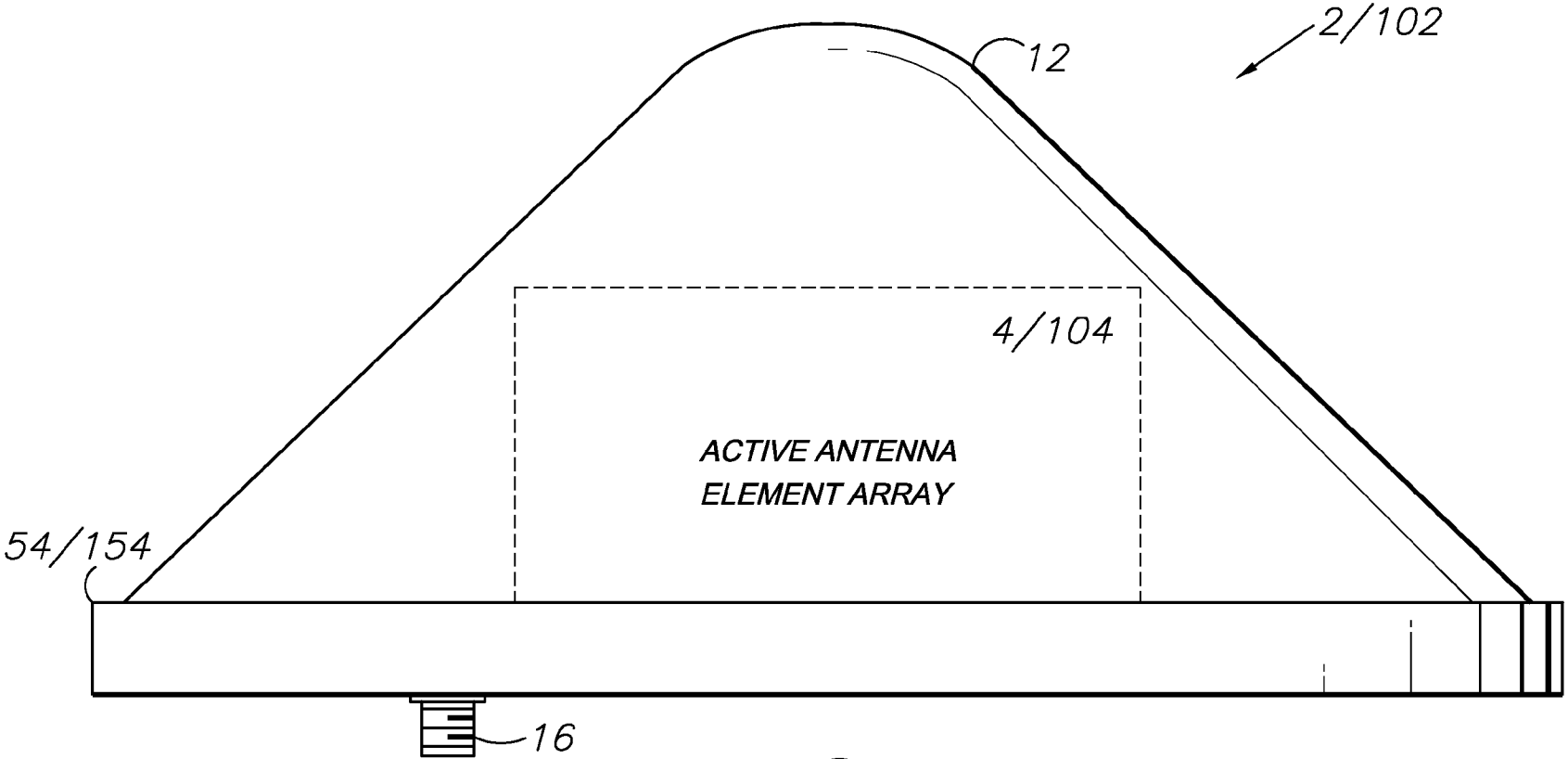
FIG. 10 is a side elevation view of an enclosed antenna constructed according to the present invention.

FIG. 10 shows an assembled antenna 2/102 including a base structure 54/154 receiving the ground base assembly 8/108 and the active antenna element array 4/104 enclosed by a radome cover 12. The output 16 can be located in the bottom of the base structure 54/154. The entire antenna 2/102 can be made weatherproof for external applications, such as mounting externally on a vehicle.

It is to be understood that the invention can be embodied in various forms, and is not to be limited to the examples discussed above. The range of components and configurations which can be utilized in the practice of the present invention is virtually unlimited.

Having thus described the invention, what is claimed as new and desired to be secured by Letters Patent is:

1. A method of manufacturing a global navigation satellite system (GNSS) antenna with printed circuit board (PCB) components, which method includes the steps of:

providing a PCB base assembly including an antenna output, a low noise amplifier (LNA) connected to the output and a hybrid connector connected to the LNA and including first and second hybrid connector outputs phase-shifted 90° relative to each other;

providing a PCB support assembly;

mounting said PCB support assembly on said base assembly;

providing first and second PCB feed networks;

connecting said first and second feed networks to said first and second hybrid connector outputs respectively;

providing said first and second feed networks with first and second balanced/unbalanced (balun) transformers respectively;

providing each said balun transformer with first and second outputs phase-shifted 180° relative to each other;

providing an array comprising four PCB radiating antenna elements;

mounting said array on said support structure; and electrically connecting each said antenna element to a respective balun output.

2. The method according to claim 1 wherein said element array has a spiral configuration with a central hub mounted on said support structure and said radiating elements spiraling outwardly and downwardly from said central hub.

3. The method according to claim 1 wherein said support assembly comprises said PCB feed networks and said radiating elements form a crossed dipole with two pairs of radiating elements and each element pair forming a bow tie configuration.

* * * * *